United States Patent [19]

Stevens

[11] Patent Number: 4,841,604

[45] Date of Patent: Jun. 27, 1989

[54] DETACHABLE BUTTON

[76] Inventor: Robert B. Stevens, Baltalimani, Cami Sokak No. 5/3, Emirgan, Istanbul, Turkey

[21] Appl. No.: 82,229

[22] Filed: Aug. 6, 1987

[51] Int. Cl.[4] ..... F16B 19/00

[52] U.S. Cl. ..... 24/704.1; 24/108; 29/413; 29/426.4; 29/432; 29/453

[58] Field of Search ..... 29/432, 453, 413, 426.4; 24/704, 104, 103, 108, 90 R, 696, 602, 693, 703

[56] References Cited

U.S. PATENT DOCUMENTS

| | | | |
|---|---|---|---|
| 245,908 | 8/1881 | Wise | 24/108 |
| 2,118,561 | 5/1938 | Kleeberg | 24/90 R X |
| 2,538,396 | 1/1951 | Sutin | 24/108 |
| 2,724,867 | 11/1955 | Smith | 29/413 X |
| 2,948,958 | 8/1960 | Flora | 29/413 X |
| 3,705,443 | 12/1972 | Camporese | 24/90 R |
| 4,579,493 | 4/1986 | Schaty | 24/108 X |
| 4,658,481 | 4/1987 | Seyler et al. | 24/704 |
| 4,664,432 | 5/1987 | Swift | 24/704 X |

FOREIGN PATENT DOCUMENTS

| | | | |
|---|---|---|---|
| 829386 | 3/1960 | United Kingdom | 24/108 |

*Primary Examiner*—Charlie T. Moon

*Attorney, Agent, or Firm*—Hurt, Richardson, Garner, Todd & Cadenhead

[57] ABSTRACT

A button arrangement which permits the temporary or permanent replacement of a lost button. The button arrangement includes a pointed shaft attached to a flat backing and a front portion which includes a button and a hollow tube which fits over the shaft. The shaft is fitted through the backside of the garment such that the flat portion abuts the garment, and the tube is fitted over the shaft and secured thereon. The flat portion can be separated from the shaft, so that the button can be removed at a later date if necessary.

11 Claims, 1 Drawing Sheet

DETACHABLE BUTTON

BACKGROUND OF THE INVENTION

Broken or lost buttons on garments such as shirts and blouses usually result from mechanical stress of washers and dryers, commercial pressing equipment, and normal wear. The discovery that a button has been broken or lost is often made at an inconvenient time, for example, while dressing, at work, traveling, or when the garment is unpackaged from the laundry. At such times, it may be inconvenient or impossible to repair the button using the tried and trued techniques of needle and thread or sewing machine. Even if a needle and thread or sewing machine is available, many individuals have difficulties manipulating these devices due to poor eyesight, coordination or the like, or are simply disinclined to engage in such activity.

There is thus a need in the art for the means of quickly and easily replacing lost buttons to garments, regardless of the circumstances surrounding the discovery of a lost button. Such a need is met by a the present invention.

DISCLOSURE OF THE INVENTION

It is accordingly an object of the invention to provide a means for quickly and easily replacing a lost button on a garment, such as a shirt or blouse, respective of the circumstances surrounding the discovery of the lost button.

It is another object of the invention to provide a means for button repair, which means can be conveniently carried by the user.

A further object of the invention is to provide a means for button repair which can be quickly and easily installed by hand and obviates the use of tools.

It is yet another object of the invention, as above, to provide a means of temporarily repairing a button, which means can be removed when it is desired to affix a permanent button to the garment.

These objects are achieved by a button attachable to a substrate, which comprises a button front, including a button structure, having opposing faces, and a hollow tube secured to one of the faces, a longitudinal axis of the tube being substantially normal to the one face, a button back including a backing structure having a flat surface, and a shaft releasably secured to the flat surface, a longitudinal axis of the shaft being substantially normal to the flat surface, the shaft including a means for penetrating the substrate, means for securing the shaft within the tube, and means for removing the backing structure from the shaft.

BRIEF DESCRIPTION OF THE DRAWINGS

For a clear understanding of the true scope of the invention, reference should be made to the following detailed description and the drawings, wherein.

DETAILED DESCRIPTION OF THE PREFERED EMBODIMENTS

Figure 1:
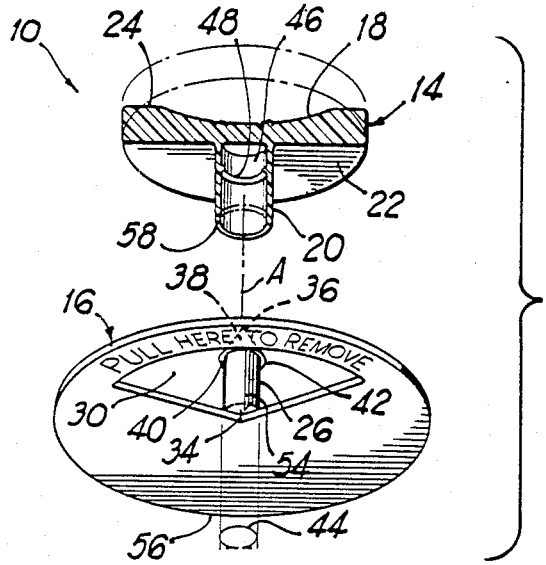
FIG. 1 is an exploded perspective view of the button assembly of the invention.
Figure 2:
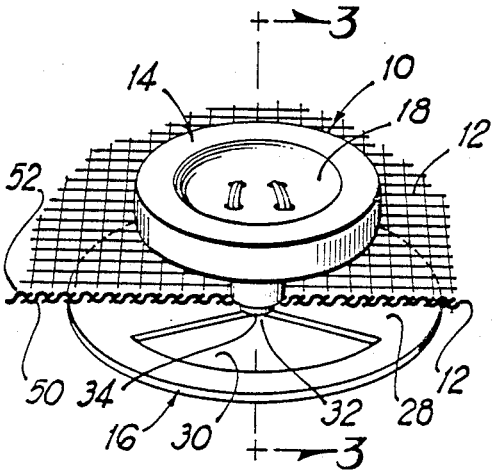
FIG. 2 is a perspective view of the button assembled in use of the invention.

With reference to FIGS. 1 and 2, a button of the invention is generally indicated by the number 10. The button 10 is secured to a substrate 12, such as the cloth of a garment, typically a shirt or blouse. The button 10 comprises two parts, a button front 14 and a button back 16.

The button front 14 includes a button structure 18 and a hollow tube 20, the later secured to opposing face 22 of the button structure 18. Opposing face 24 of the button structure has the appearance of an ordinary button, that is, it can take the shape of any one of enumerable, or unusual shapes employed in the industries for securing garments. To aid in appearance, the opposing face 24 may include a plurality of holes filled with thread to present the illusion that the button is sewed on to the garment, alternately the thread and thread holes may be molded onto the face 24 as shown in FIG. 2. Along opposing face 22, the hollow tube 20 is secured by a snap fit, preferably within a central region of the opposing face 24.

Figure 3:
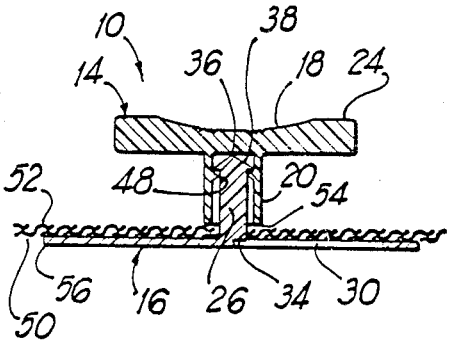
FIG. 3 is an elevational cross-section of the secured structure of the button invention.

The hollow tube 20 receives a shaft 26, having a longitudinal axis A, of the button back 16. As shown in FIGS. 1 and 3, the button back 16 includes the shaft 26 and a backing structure 28. The shaft 26 is secured to the backing structure 28, preferably also within a central region thereof. The backing structure can contain an aperture or open space 30, which optionally extends to a central region 32 where the shaft is positioned. As shown specifically in FIG. 3, the open space or aperture 30 may extend to the base of the shaft 26, such that only a portion of the base 34 of the shaft 26 is secured to the backing structure 28.

As seen in FIGS. 1 and 3, the shaft 26 includes a pointed end 36, which can take the form of a conical member 38, the base 40 of which is secured to the shaft 26.

The base 40 of the conical member 38 can have an edge 42 which extends radially outward from the circumference 44 of the shaft 26. The purpose of this outward extension is to provide a means for engaging the inner wall 46 of the hollow tube in snap-fit arrangement, as described in detail herein below.

As shown specifically in FIGS. 1 and 3, the hollow tube 20 contains a protrusion 48 which extends radially inward from the inner wall 46 of the tube 20. This protrusion may take the form of an annulus, such as a wedge-shaped annulus having a radially inwardly-facing apex.

When the shaft 26 is inserted into the hollow tube 20, as shown in FIG. 1, the inwardly extending protrusion 48 of the hollow tube engages the radially-outwardly extending edge 42 of the shaft 26, thereby providing snap-fit securement of the button back to the button front.

In operation, the user simply pushes the shaft 26 through a first side 50 of the substrate, until the backing structure 28 abuts the side 50 of the substrate, typically as the inside of a garment. The shaft 26 thus extends outward from the second side 52 of the garment, which second side is that normally exposed. Once this is accomplished, the button front 14 is applied over the shaft 26 as described previously, the shaft extending into the hollow tube 20. To facilitate the insertion of the shaft 26 into the tube 20, particularly the edge 42 which extends radially from the wall of the shaft, the tube 20 may be provided with one or more slits 54 (FIG. 1) which can extend longitudinally along the length of the tube 20, and which expand upon insertion of the shaft. As the button front 14 and the button back 16 are pressed together, the edge 42 on the shaft 26 passes through the protrusion 48 in the hollow tube and snaps in place, as described above.

Once so applied to the garment, the button 10 of the invention can be utilized in a manner consistent with a normally sewn-on button, either on a permanent basis or as a temporary "fix" until time and materials are available for sewing on a conventional button. When the latter is desired, the button 10 of the invention can be removed simply by separating the backing structure 28 from the shaft 26 through the application of force, preferably along an edge 56 of the backing structure. Once the backing structure is removed, the button front 14, together with the shaft 26 still inserted in the hollow tube 20, can be removed from the second side (front) 52 of the garment or other substrate 12.

To facilitate removal of the backing structure 28, as pointed out above, the backing structure 28 can have an open space 30. When the open space 30 extends to the central region 32, exposing or under-cutting a portion of the base 34 of the shaft 26, securment of the shaft to the backing structure is weakened, such that the backing structure is easily removed upon the application of force to a location spaced from the point of securment of the backing structure to the shaft opposite the under-cut region 32.

Preferably, the shaft 26 extends from the end 58 of the hollow tube away from the button front 14 by a distance greater than the thickness of the substrate 12. This arrangement eliminates any disfigurment of the garment where the end 58 of the hollow tube might apply excessive pressure to the garment during application of the button 10.

Another prefered feature is that the area of the backing structure 28 be greater than that of the button structure 18. This larger size for the backing structure 28 aids in the removal of the backing structure 28 by the user, and also provides a visual cue that a permanent "thread type" repair may be necessary at a later date.

Although the invention has been described in considerable detail and aforegoing for the purpose of illustration, it is to be understood that such detail is solely for this purpose and that variations can be made by those skilled in the art without departing from the spirit and scope of the invention.

What is claimed is:

1. A button attachable to a substrate, comprising:

a button front including a button structure having oppposing faces, and a hollow tube secured to one of said faces, a longitudinal axis of said tube being substantially normal to said one face;

a button back including a backing structure having a flat surface, and a shaft releasably secured to said flat surface, a longitudinal axis of said shaft being substantially normal to said flat surfce, said shaft including means for penetrating said substrate and the securement of said shaft to said flat surface being weakened by an aperture in said backing structure at said shaft secured thereto to facilitate removal of the backing structure from the shaft upon the application of force to the backing structure; and means for securing said shaft within said tube.

2. A button as claimed in claim 1, wherein said means for penetrating said substrate includes a pointed tip on said shaft.

3. A button as claimed in claim 1, wherein said means for securing said shaft within said tube includes a protrusion extending radially outwardly from an outer circumference of said shaft, and a protrusion extending radially inwardly from the inner wall of said hollow tube, said shaft being insertable in said hollow tube in a manner such that said radially outward shaft protrusion engages said radially inward shaft protrusion.

4. A button as claimed in claim 3, wherein said radially outward shaft protrusion comprises a circumferential edge, and said radially inward shaft protrusion comprises an annulus.

5. A button as claimed in claim 4, wherein said annulus is wedge-shaped, having a radially inwardly-facing apex, and wherein said circumferential edge of said radially outward shaft protrusion is an annulus having a radially outwardly-facing apex.

6. A button as claimed in claim 4, wherein said means for penetrating said substrate includes a conical member formed on an end of said shaft, and wherein said circumferential edge of said radially outward shaft protrusion is formed by a circumferential edge of the base of said conical member.

7. A button as claimed in claim 4, wherein said hollow tube includes at least one longitudinal slit means for facilitating the insertion of said shaft in said tube.

8. A button as claimed in claim 1, wherein said shaft is secured at a center portion of said backing structure, and wherein said aperture extends to said center portion.

9. A button as claimed in claim 1, wherein said shaft has a length such that when said shaft is inserted in said hollow tube, said flat surface of said backing structure is spaced from an end of said hollow tube.

10. A button as claimed in claim 9, wherein said flat surface is spaced from said end of said hollow tube by the thickness of said substrate.

11. A button as claimed in claim 1, wherein said flat surface of said backing structure has an area larger than the area of either of said opposing faces of said button structure.

* * * * *

UNITED STATES PATENT AND TRADEMARK OFFICE

CERTIFICATE OF CORRECTION

PATENT NO. : 4,841,604

DATED : June 27, 1989

INVENTOR(S) : Robert B. Stevens

It is certified that error appears in the above—identified patent and that said Letters Patent is hereby corrected as shown below: Title page, inventor's address should read:

-- Robert B. Stevens
P. O. Box 36222
Grosse Pointe, MI 48236 --

Signed and Sealed this

Eighth Day of May, 1990

*Attest:*

HARRY F. MANBECK, JR.

*Attesting Officer*

*Commissioner of Patents and Trademarks*